US010670378B1

(12) United States Patent
Lee

(10) Patent No.: US 10,670,378 B1
(45) Date of Patent: Jun. 2, 2020

(54) BULLET CONTAINMENT DEVICE

(71) Applicant: APEX TACTICAL SPECIALTIES, INC., Peoria, AZ (US)

(72) Inventor: Randall M. Lee, Peoria, AZ (US)

(73) Assignee: APEX TACTICAL SPECIALTIES, INC., Peoria, AZ (US)

( * ) Notice: Subject to any disclaimer, the term of this patent is extended or adjusted under 35 U.S.C. 154(b) by 0 days.

(21) Appl. No.: 16/276,622

(22) Filed: Feb. 15, 2019

(51) Int. Cl.
*F41J 13/00* (2009.01)
*F41C 33/04* (2006.01)

(52) U.S. Cl.
CPC ..... *F41J 13/00* (2013.01); *F41C 33/04* (2013.01)

(58) Field of Classification Search
CPC ... F41C 3/04; F41C 33/02; F41A 17/54; F41J 13/00; F41G 3/26
USPC ..... 42/70.01, 90, 70.11
See application file for complete search history.

(56) References Cited

U.S. PATENT DOCUMENTS 944,355 A 12/1909 Beasley
6,128,847 A * 10/2000 Langner ..... F41A 17/54 42/106
6,253,915 B1 * 7/2001 Mesica ..... F41C 33/06 206/317
2005/0241208 A1 * 11/2005 Ditchfield ..... F41C 33/0218 42/106
2012/0061432 A1 * 3/2012 Novak ..... F41C 33/0209 224/243
2012/0152776 A1 * 6/2012 Camp ..... F41C 33/0263 206/317
2017/0292809 A1 * 10/2017 Romano ..... F41H 5/0471

FOREIGN PATENT DOCUMENTS

WO 9219927 11/1992
WO WO-9219927 A1 * 11/1992 ..... F41A 17/44
WO 2011031314 3/2011
WO WO-2011031314 A2 * 3/2011 ..... F41C 33/0209

* cited by examiner

*Primary Examiner* — John Cooper
(74) *Attorney, Agent, or Firm* — Fitch, Even, Tabin & Flannery, LLP

(57) ABSTRACT

Systems and methods for containing discharge from a holstered firearm are described. The system may include a bullet containment device (BCD) with a rectangular backing plate coupled to a firearm holster, a U-shaped housing having a base, two sides, and a top opening, a front plate coupled to housing such that the housing is interposed between the front plate and the backing plate, an upper shelf coupled to and normal to the housing sides, whereby the upper shelf, front plate, housing, and backing plate form an interior cavity generally in line with a bore axis of the firearm when the apparatus is coupled to the holster and the firearm is fully seated in the holster, whereby a bullet fired from the firearm while seated in the holster is confined to the interior cavity, and a lower shelf coupled to and generally normal to the housing sides.

26 Claims, 13 Drawing Sheets

BULLET CONTAINMENT DEVICE

BACKGROUND

The following relates generally to firearm safety, and more specifically to a bullet containment device (BCD) for containing discharge from a holstered firearm.

A variety of systems are in use for carrying firearms. For example, a holster may be used for carrying a handgun or for other firearms. A holster may be made of plastic, leather, metal, and other materials, and may be worn on a belt or under the arm. In some cases, a firearm may discharge when being carried in a holster. This may result in serious injury to the person carrying the holstered firearm, as well as damage to other nearby people or property.

SUMMARY

An apparatus for containing discharge from a holstered firearm is described. The apparatus may include a generally rectangular backing plate configured to be coupled to a firearm holster, a generally U-shaped housing having a base, two sides, and a top opening, a front plate coupled to housing such that the housing is interposed between the front plate and the backing plate, an upper shelf coupled to and generally normal to the housing sides, wherein the upper shelf is proximate to the top opening, whereby the upper shelf, front plate, housing, and backing plate form an interior cavity generally in line with an axis of a bore of the firearm when the apparatus is coupled to the holster and the firearm is fully seated in the holster, whereby a bullet fired from the firearm while seated in the holster is confined to the interior cavity, and a lower shelf coupled to and generally normal to the housing sides, wherein the lower shelf is located in the interior cavity between the upper shelf and the base.

A system for containing discharge from a holstered firearm is described. The system may include firearm, holster, and a bullet containment device (BCD). The BCD may also include a generally rectangular backing plate configured to be coupled to a firearm holster, a generally U-shaped housing having a base, two sides, and a top opening, a front plate coupled to housing such that the housing is interposed between the front plate and the backing plate, an upper shelf coupled to and generally normal to the housing sides, wherein the upper shelf is proximate to the top opening, whereby the upper shelf, front plate, housing, and backing plate form an interior cavity generally in line with an axis of a bore of the firearm when the apparatus is coupled to the holster and the firearm is fully seated in the holster, whereby a bullet fired from the firearm while seated in the holster is confined to the interior cavity, and a lower shelf coupled to and generally normal to the housing sides, wherein the lower shelf is located in the interior cavity between the upper shelf and the base.

A method for containing discharge from a holstered firearm is described. The method may include attaching a bullet discharge apparatus to the holster, wherein the bullet discharge apparatus includes a housing, an upper shelf coupled to the housing, an interior cavity bounded in part by the upper shelf and the housing, and a lower shelf parallel to the upper shelf and located in the interior cavity, wherein the interior cavity is generally in line with an axis of a bore of the firearm when the apparatus is coupled to the holster and the firearm is fully seated in the holster, placing a firearm in the holster, discharging a bullet from the firearm, traveling of the bullet through the upper shelf into the interior cavity, wherein a velocity of the bullet is slowed by the impact of the bullet with the upper shelf, and trapping of the bullet within the lower shelf.

DETAILED DESCRIPTION

Figure 1:
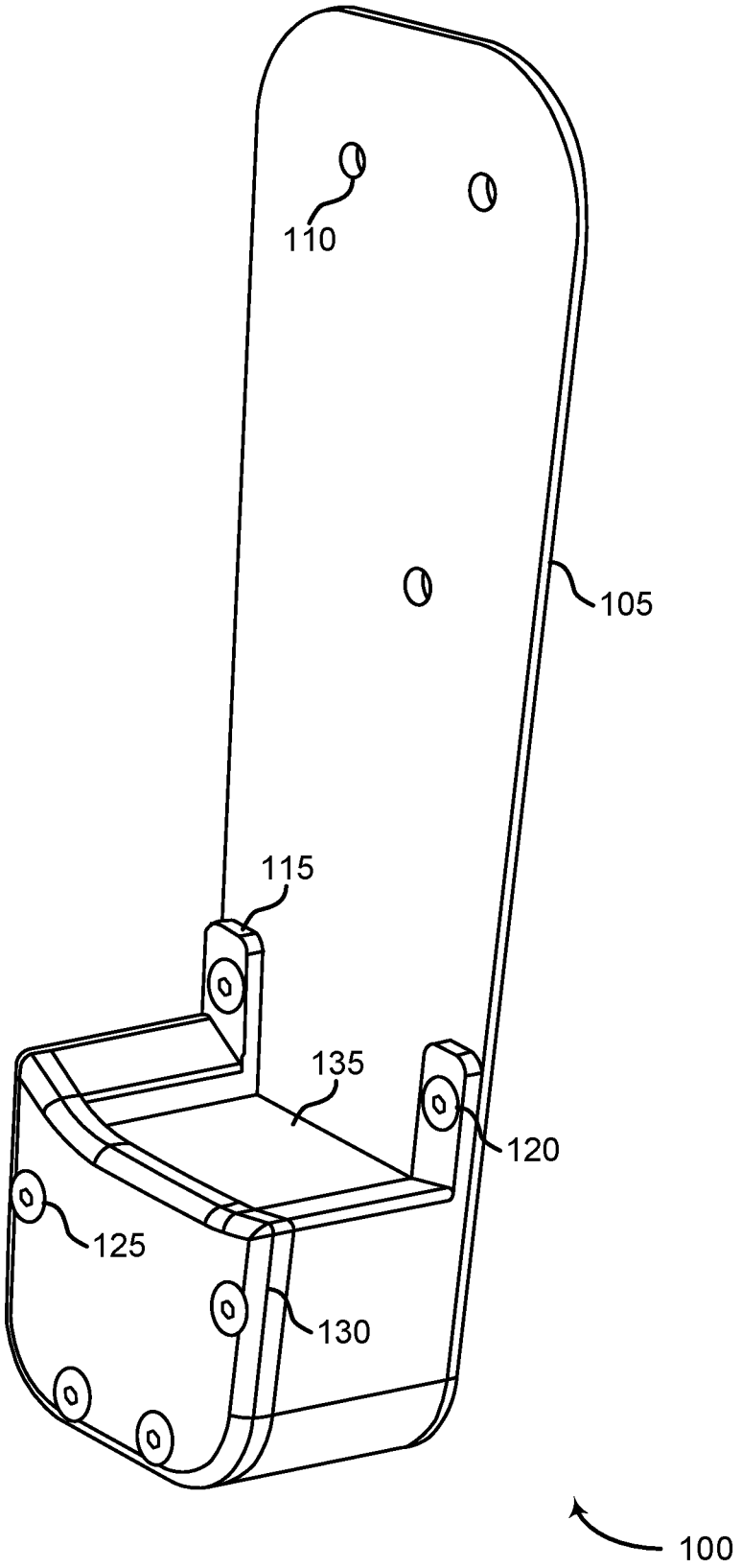
FIG. 1 shows an example of a perspective view of a bullet containment device (BCD) in accordance with aspects of the present disclosure.

FIG. 1 shows an example of a perspective view of a bullet containment device/bullet containment apparatus (BCD) 100 in accordance with aspects of the present disclosure. The BCD 100 may be attached to the rear face of a holster. In some embodiments the BCD 100 is configured to attach to a holster designed for law enforcement use. In some embodiments the BCD 100 is configured for "common duty" holsters. BCD 100 may include backing plate 105, holes 110, tabs 115, housing screws 120, front screws 125, front cover 130, and upper plate 135.

The BCD 100 includes a bullet-containing portion located immediately in the bullet path when the BCD 100 is attached to the holster. The bullet-containing portion includes two parallel plates coupled to a housing. The plates may be oriented generally perpendicular to the path of a bullet.

Another benefit of the BCD 100 is that it does not affect the function of the holster, unlike some other bullet containment apparatuses which require wrapping of the barrel itself. In some embodiments there are two plates (i.e., an upper plate 135 and a lower plate). In some embodiments there is only one plate.

In some examples, the apparatus is integrally formed. In some examples, the apparatus is injection molded. In some examples, the apparatus comprises polycarbonate. In some examples, the apparatus consists of UV-resistant material. UV-resistant material as defined herein is a material capable of ensuring a service life of at least five years under anticipated UV exposure. In some embodiments the material is rendered UV-resistant by UV-stabilizers/additions in the material. In other embodiments the material is rendered UV-resistant by hard-coating the material with a UV-resistant coating.

BCD 100 may be attached to a holster, and may include a housing, an upper shelf coupled to the housing, an interior cavity bounded in part by the upper shelf and the housing, and a lower shelf parallel to the upper shelf and located in the interior cavity, wherein the interior cavity is generally in line with an axis of a bore of the firearm when the apparatus is coupled to the holster and the firearm is fully seated in the holster. BCD 100 may be an example of, or include aspects of, the corresponding elements described with reference to FIGS. 2-4, and 7-11.

Backing plate 105 may be configured to be coupled to a firearm holster. In some examples, the backing plate 105 includes a plurality of holes 110 configured for coupling to a holster guard. Backing plate 105 may be an example of, or include aspects of, the corresponding elements described with reference to FIGS. 2-4, 7, 9, and 11.

Holes 110 may be an example of, or include aspects of, the corresponding elements described with reference to FIGS. 2-4. Tabs 115 may be an example of, or include aspects of, the corresponding elements described with reference to FIGS. 2, 3, and 5.

Housing screws 120 may be an example of, or include aspects of, the corresponding elements described with reference to FIGS. 2-4. Front screws 125 may be an example of, or include aspects of, the corresponding elements described with reference to FIGS. 2-4, and 8-10.

Front cover 130 may be an example of a front plate coupled to housing such that the housing is interposed between the front plate and the backing plate 105. Front cover 130 may be an example of, or include aspects of, the corresponding elements described with reference to FIGS. 2, 6-8, and 11.

Upper plate 135 may be an example of an upper shelf coupled to and generally normal to the housing sides, where the upper shelf is proximate to the top opening, whereby the upper shelf, front plate, housing, and backing plate 105 form an interior cavity generally in line with an axis of a bore of the firearm when the apparatus is coupled to the holster and the firearm is fully seated in the holster, whereby a bullet fired from the firearm while seated in the holster is confined to the interior cavity. In some examples, the upper shelf has a thickness between 6.35 mm (0.25 inches) and 7 mm (0.275 inches).

Upper plate 135 may slow travel of the bullet through the upper shelf into the interior cavity, wherein a velocity of the bullet is slowed by the impact of the bullet with the upper shelf. In some examples, a thickness of the upper shelf is between 6.35 mm (0.25 inches) and 7 mm (0.275 inches). Upper plate 135 may be an example of, or include aspects of, the corresponding elements described with reference to FIGS. 2, 3, and 11.

Figure 2:
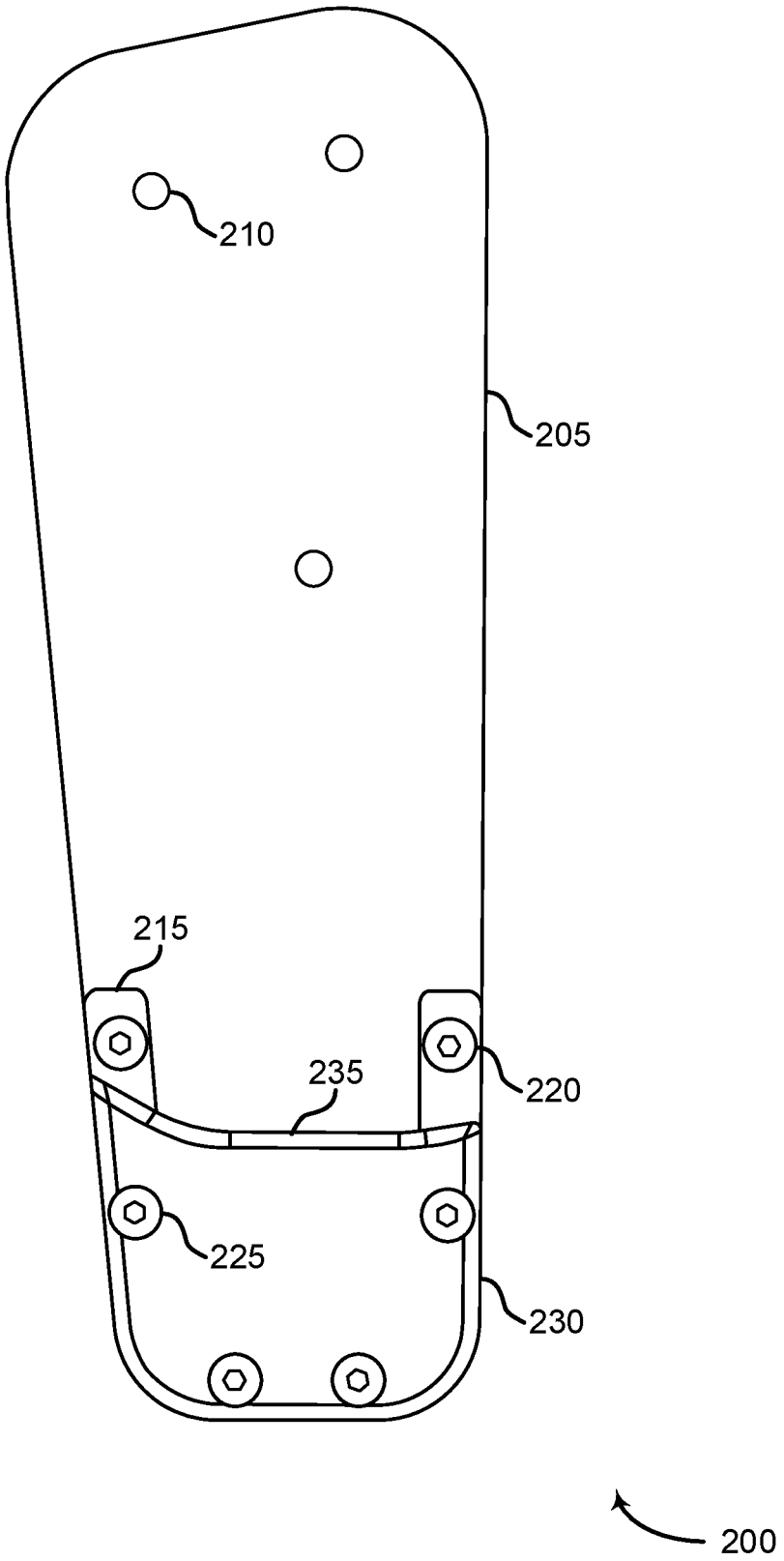
FIG. 2 shows an example of a front elevation of the BCD in accordance with aspects of the present disclosure.

FIG. 2 shows an example of a front elevation of the BCD 200 in accordance with aspects of the present disclosure. BCD 200 may be an example of, or include aspects of, the corresponding elements described with reference to FIGS. 1, 3, 4, and 7-11. BCD 200 may include backing plate 205, holes 210, tab 215, housing screws 220, front screws 225, front cover 230, and upper plate 235.

Backing plate 205 may be an example of, or include aspects of, the corresponding elements described with reference to FIGS. 1, 3, 4, 7, 9, and 11. Holes 210 may be an example of, or include aspects of, the corresponding elements described with reference to FIGS. 1, 3, and 4. Tabs 215 may be an example of, or include aspects of, the corresponding elements described with reference to FIGS. 1, 3, and 5.

Housing screws 220 may be an example of, or include aspects of, the corresponding elements described with reference to FIGS. 1, 3, and 4. Front screws 225 may be an example of, or include aspects of, the corresponding elements described with reference to FIGS. 1, 3, 4, and 8-10.

Front cover 230 may be an example of, or include aspects of, the corresponding elements described with reference to FIGS. 1, 6-8, and 11. Upper plate 235 may be an example of, or include aspects of, the corresponding elements described with reference to FIGS. 1, 3, and 11.

Figure 3:
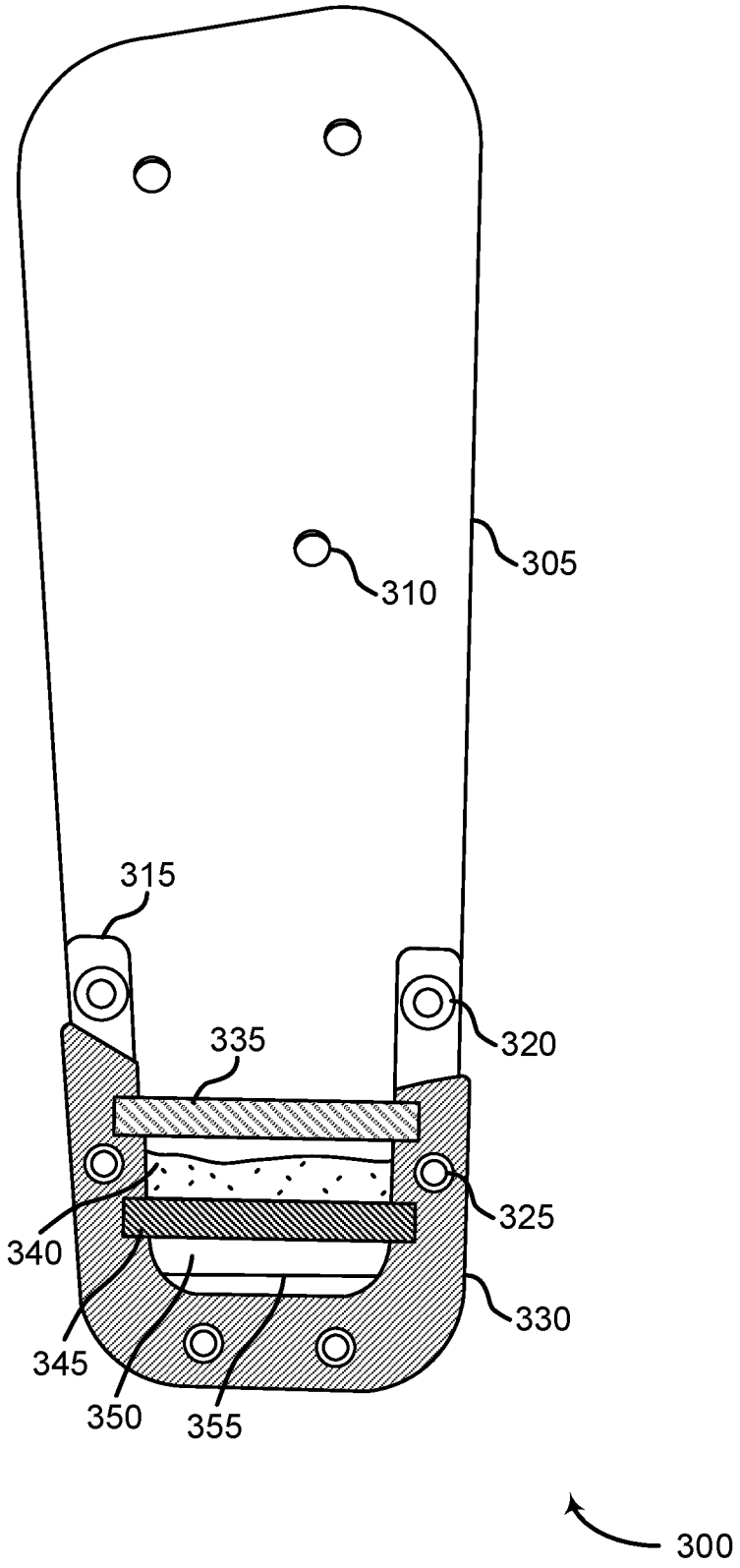
FIG. 3 shows an example of a front sectional view of the BCD in accordance with aspects of the present disclosure.

FIG. 3 shows an example of a front sectional view of the BCD 300 in accordance with aspects of the present disclosure. BCD 300 may include backing plate 305, holes 310, tab 315, housing screws 320, front screws 325, housing 330, upper plate 335, intermediate material 340, lower plate 345, internal cavity 350, and emergency capture plate 355.

When a bullet strikes the upper plate 335, in some cases the bullet and fragments may be entirely captured by the upper plate 335. In other cases, the bullet passes through the upper plate 335 but the velocity is slowed so that the bullet (including bullet fragments) is trapped in the lower plate 345. If the bullet passes through the upper plate 335, the upper plate 335 may still trap fragments from the bullet, either fragments generated when the bullet passes through the upper plate 335 or any rebounding bullet fragments from contact of the bullet with other portions of the BCD 300. Additional bullet fragments are trapped by the lower plate 345 and/or the exterior housing 330 of the BCD 300. The bullet and all bullet fragments are trapped within the BCD 300.

The thickness of the upper plate 335 is thin enough so that the bullet does not bounce back, but thick enough that it slows the bullet enough for it to be trapped in the lower plate 345. The lower plate 345 is thick enough to trap the bullet at the velocity it exits from the upper plate 335.

A separate emergency capture plate 355 may optionally be coupled to the upper inside face of the base of the housing 330. In some cases, emergency capture plate 355 may be made from a metallic material. The emergency capture plate 355 is located in the travel path of the bullet and may provide an additional bullet/fragments capturing device if the bullet and/or fragments are not completely captured in the other bullet/fragment capturing elements of the BCD 300 (as could possibly be the case with high-energy bullets).

In some embodiments, the entire BCD apparatus is injection-molded from polycarbonate. In other embodiments, the parts besides the plates are made of any form-retaining material (or materials) such as aluminum, steel, or titanium. In the case where the housing 330 is made from metal, the housing 330 itself can function as the emergency capture plate 355. Although other materials, such as Kevlar®, may also be used for construction the BCD 300, polycarbonate may provide the additional advantage of being UV resistant. In some embodiments the plates are made from ultra-high molecular weight polyethylene.

In some embodiments the upper plate 335 is around 0.25" to 0.275" thick. The lower plate 345 is around 0.5" thick. The spacing between the plates is around 0.39". The plate thickness is designed to slow the bullet's (projectile's)

highest velocity down before the remaining energy is absorbed by the lower plate 345. The upper plate 335 also acts as a debris shield to contain debris and bullet fragments that might potentially rebound back up toward the user.

In some embodiments the gap between the two plates is partially filled with an intermediate material 340, such as a visco-elastic polymer. The intermediate material 340 absorbs some of the kinetic energy of the projectile as it travels through the polymer towards the lower plate 345. This is a benefit with hyper velocity ammunition where the initial velocity is very high. The intermediate material 340 also functions to start expansion and spread force out before the lower plate 345.

BCD 300 may be an example of, or include aspects of, the corresponding elements described with reference to FIGS. 1, 2, 4, and 7-11. Backing plate 305 may be an example of, or include aspects of, the corresponding elements described with reference to FIGS. 1, 2, 4, 7, 9, and 11.

Holes 310 may be an example of, or include aspects of, the corresponding elements described with reference to FIGS. 1, 2, and 4. Tabs 315 may be an example of, or include aspects of, the corresponding elements described with reference to FIGS. 1, 2, and 5.

Housing screws 320 may be an example of, or include aspects of, the corresponding elements described with reference to FIGS. 1, 2, and 4. Front screws 325 may be an example of, or include aspects of, the corresponding elements described with reference to FIGS. 1, 2, 4, and 8-10.

Housing 330 may have a base, two sides, and a top opening. In some examples, the U-shaped housing 330 comprises a top edge shaped to accommodate the proximate portion of the holster. In some examples, the U-shaped housing 330 has a thickness between 11.4 mm (0.45 inches) and 14 mm (0.55 inches) In some examples, the coupling of the upper shelf and the lower shelf to the housing 330 includes the upper shelf and the lower shelf received by notches in the interior faces of the U-shaped housing 330.

Housing 330 may be an example of, or include aspects of, the corresponding elements described with reference to FIGS. 5, 7, and 8. Upper plate 335 may be an example of, or include aspects of, the corresponding elements described with reference to FIGS. 1, 2, and 11. Intermediate material 340 may be an example of a visco-elastic polymer contained within a portion of sealed interior cavity between the upper shelf and the lower shelf.

In some examples, the bullet discharge apparatus further comprises a visco-elastic polymer sealed within a portion of interior cavity between the upper shelf and the lower shelf. Intermediate material 340 may also travel of the bullet through the visco-elastic polymer after traveling of the bullet into the interior cavity, whereby the velocity of the bullet is further slowed.

Lower plate 345 may be an example of a lower shelf coupled to and generally normal to the housing 330 sides, wherein the lower shelf is located in the interior cavity between the upper shelf and the base. In some examples, the upper shelf and lower shelf are comprised of polycarbonate. In some examples, the upper shelf is separated from the lower shelf by a gap of between 8.6 mm (0.34 inches) and 11.2 mm (0.44 inches). In some examples, the lower shelf has a thickness between 11.4 mm (0.45 inches) and 14 mm (0.55 inches). In some examples, the upper shelf and lower shelf are comprised of UV-resistant material. In some examples, the upper shelf and lower shelf are comprised of ultra-high molecular-weight polyethylene.

Lower plate 345 may trap of the bullet within the interior cavity. In some examples, the upper shelf and the lower shelf are comprised of polycarbonate. In some examples, a gap between the upper shelf and the lower shelf is between 8.6 mm (0.34 inches) and 11.2 mm (0.44 inches). In some examples, a thickness of the lower shelf is between 11.4 mm (0.45 inches) and 14 mm (0.55 inches). In some examples, the upper shelf and lower shelf are comprised of UV-resistant material. Lower plate 345 may be an example of, or include aspects of, the corresponding elements described with reference to FIG. 11.

In some examples, the interior cavity is sealed. In some examples, the interior cavity is configured to confine the bullet when the firearm is 75-100% of the fully seated position (as measured from 0% as the muzzle enters the cavity to 100% for the muzzle is in the fully seated position). Internal cavity 350 may prevent any bullet fragments from exiting the interior cavity. In some examples, the interior cavity is configured to confine the bullet when the firearm is 75-100% of the fully seated position. Emergency capture plate 355 may be an example of, or include aspects of, the corresponding elements described with reference to FIG. 5.

Figure 4:
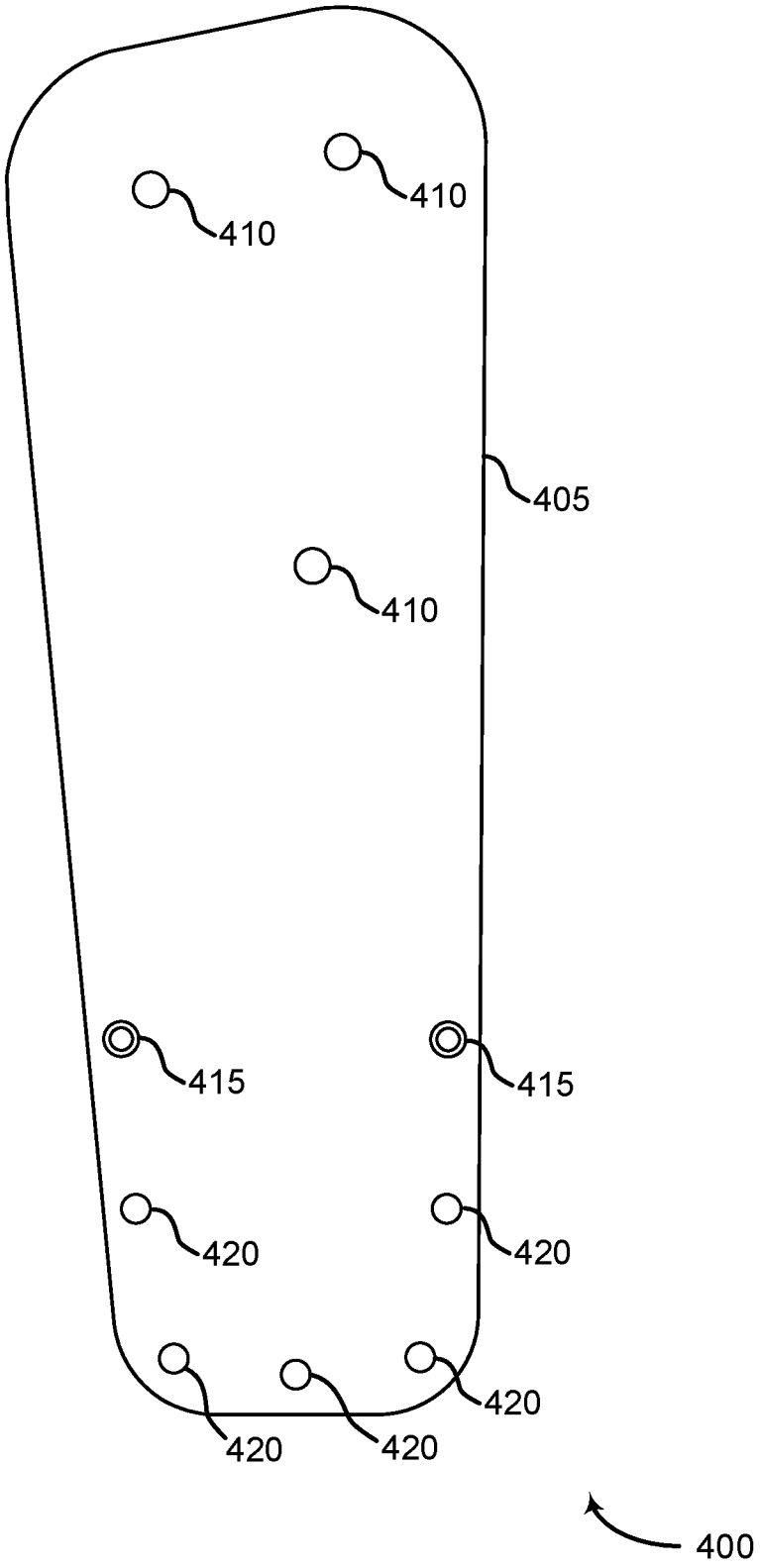
FIG. 4 shows an example of a rear elevation of the BCD in accordance with aspects of the present disclosure.

FIG. 4 shows an example of a rear elevation of the BCD 400 in accordance with aspects of the present disclosure. BCD 400 may include backing plate 405, holes 410, housing screws 415, and front screws 420.

BCD 400 may be an example of, or include aspects of, the corresponding elements described with reference to FIGS. 1-3, and 7-11. Backing plate 405 may be an example of, or include aspects of, the corresponding elements described with reference to FIGS. 1-3, 7, 9, and 11.

Holes 410 may be an example of, or include aspects of, the corresponding elements described with reference to FIGS. 1-3. Housing screws 415 may be an example of, or include aspects of, the corresponding elements described with reference to FIGS. 1-3. Front screws 420 may be an example of, or include aspects of, the corresponding elements described with reference to FIGS. 1-3, and 8-10.

Figure 5:
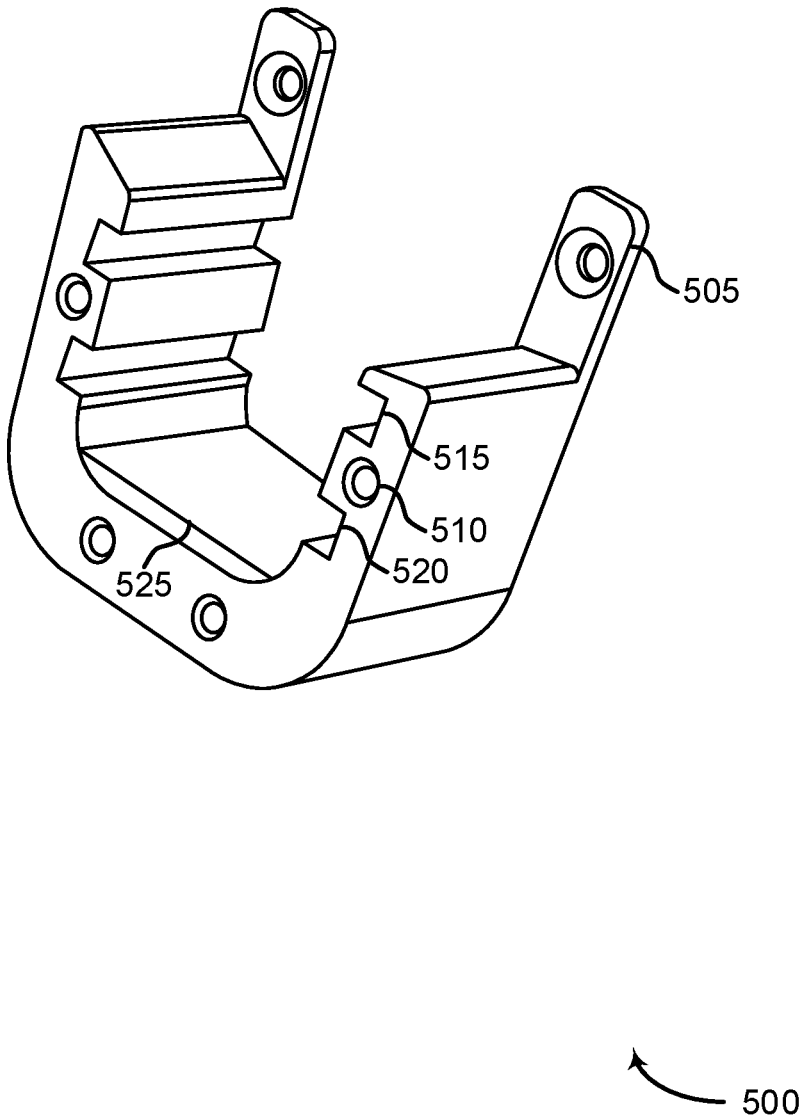
FIG. 5 shows an example of a perspective view of a housing of the BCD in accordance with aspects of the present disclosure.

FIG. 5 shows an example of a perspective view of a housing 500 of the BCD in accordance with aspects of the present disclosure. Housing 500 may include tabs 505, housing holes 510, upper notch 515, lower notch 520, and emergency capture plate 525.

Housing 500 may be an example of, or include aspects of, the corresponding elements described with reference to FIGS. 3, 7, and 8. Tabs 505 may be an example of, or include aspects of, the corresponding elements described with reference to FIGS. 1-3. Emergency capture plate 525 may be an example of, or include aspects of, the corresponding elements described with reference to FIG. 3.

Figure 6:
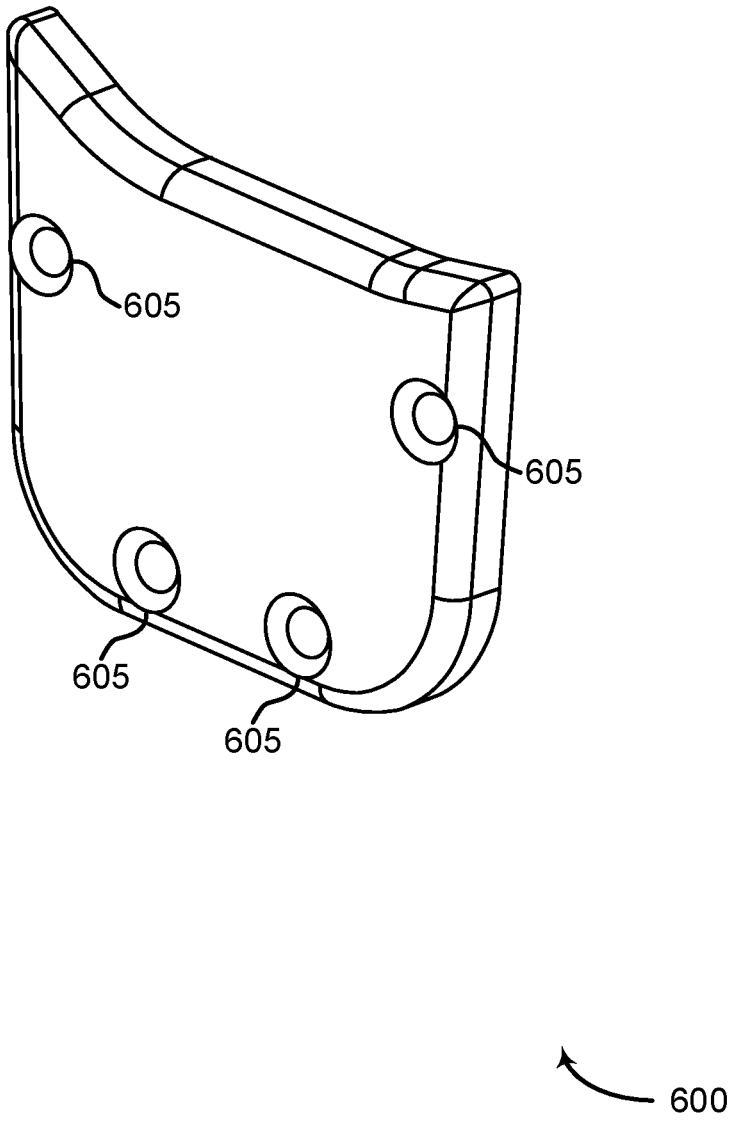
FIG. 6 shows an example of a perspective view of a front cover of the BCD in accordance with aspects of the present disclosure.

FIG. 6 shows an example of a perspective view of a front cover 600 of the BCD in accordance with aspects of the present disclosure. Front cover 600 may include front cover holes 605. Front cover 600 may be an example of, or include aspects of, the corresponding elements described with reference to FIGS. 1, 2, 7, 8, and 11.

Figure 7:
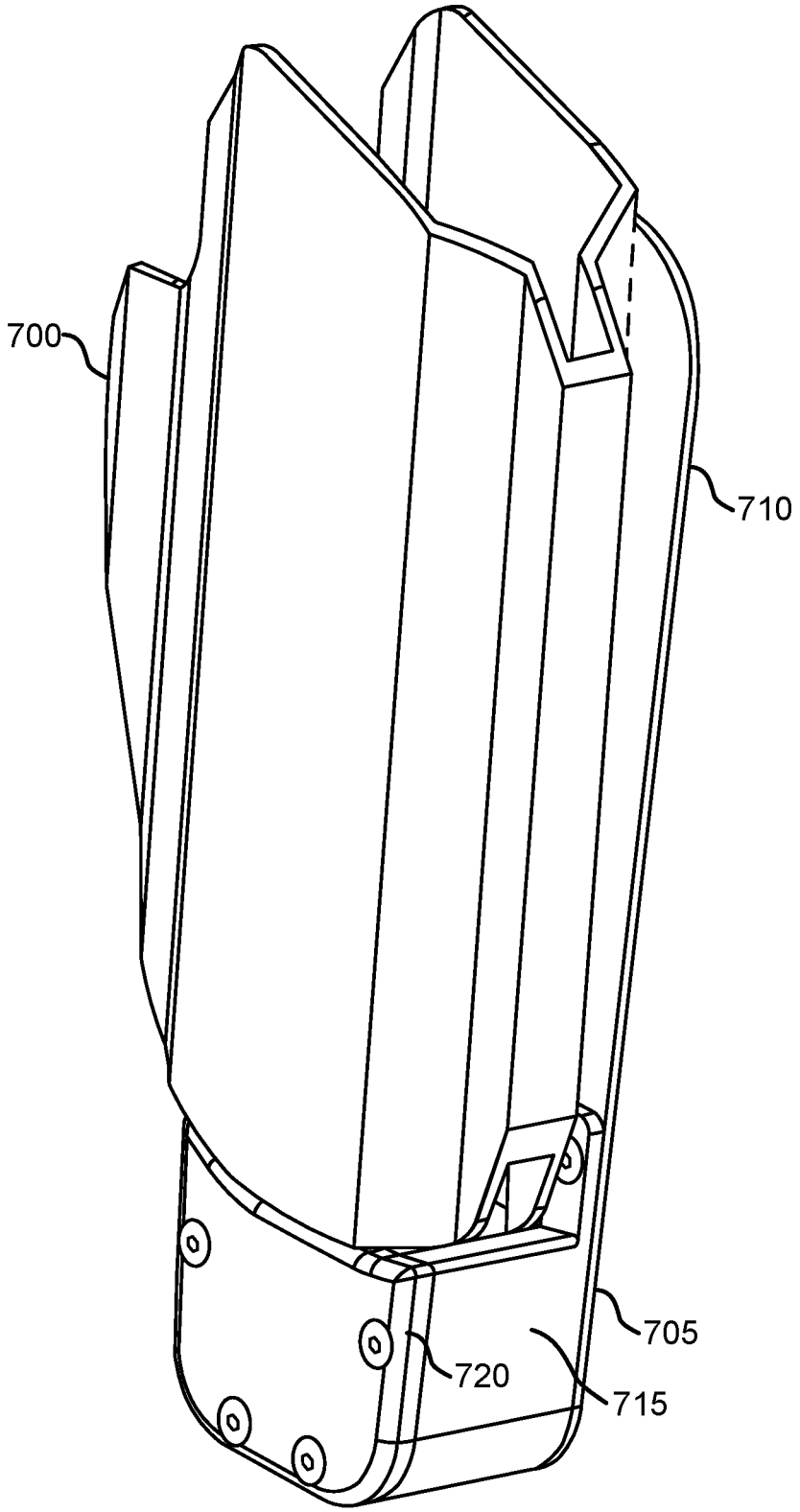
FIG. 7 shows an example of a perspective view of a holster coupled to the BCD in accordance with aspects of the present disclosure.

FIG. 7 shows an example of a perspective view of a holster 700 coupled to the BCD 705 in accordance with aspects of the present disclosure. The example shown includes holster 700 and BCD 705.

Holster 700 may be configured to carry a firearm, such that a user may place a firearm in the holster 700. Holster 700 may be an example of, or include aspects of, the corresponding elements described with reference to FIGS. 8-11.

BCD 705 may be an example of, or include aspects of, the corresponding elements described with reference to FIGS. 1-4, and 8-11. BCD 705 may include backing plate 710, housing 715, and front cover 720. Backing plate 710 may be an example of, or include aspects of, the corresponding elements described with reference to FIGS. 1-4, 9, and 11. Housing 715 may be an example of, or include aspects of, the corresponding elements described with reference to FIGS. 3, 5, and 8. Front cover 720 may be an example of, or include aspects of, the corresponding elements described with reference to FIGS. 1, 2, 6, 8, and 11.

Figure 8:
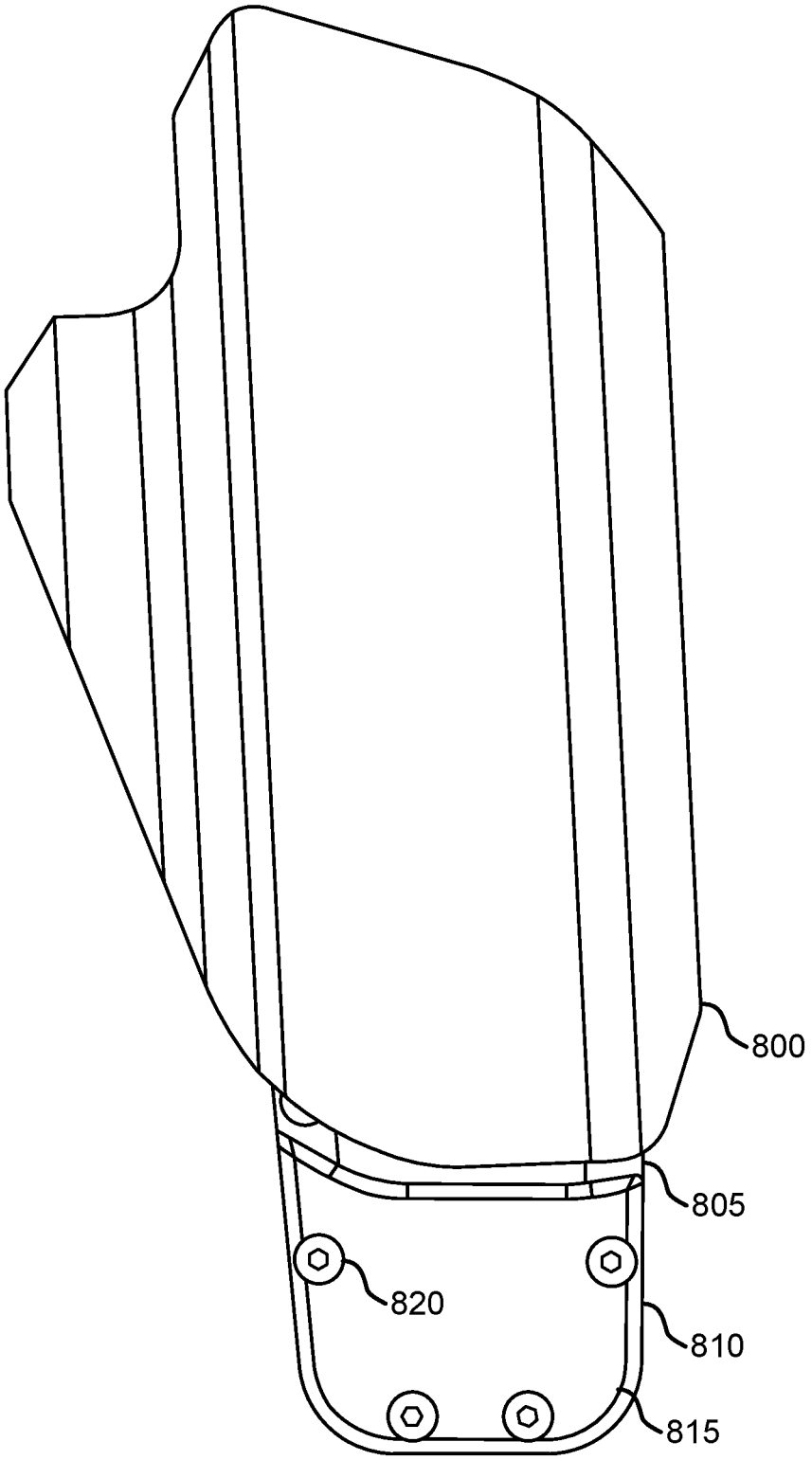
FIG. 8 shows an example of a front elevation of the holster coupled to the BCD in accordance with aspects of the present disclosure.

FIG. 8 shows an example of a front elevation of the holster 800 coupled to the BCD 805 in accordance with aspects of the present disclosure. The example shown includes holster 800 and BCD 805.

Holster 800 may be an example of, or include aspects of, the corresponding elements described with reference to FIGS. 7, and 9-11. BCD 805 may be an example of, or include aspects of, the corresponding elements described with reference to FIGS. 1-4, 7, and 9-11.

BCD 805 may include housing 810, front cover 815, and front screws 820. Housing 810 may be an example of, or include aspects of, the corresponding elements described with reference to FIGS. 3, 5, and 7. Front cover 815 may be an example of, or include aspects of, the corresponding elements described with reference to FIGS. 1, 2, 6, 7, and 11. Front screws 820 may be an example of, or include aspects of, the corresponding elements described with reference to FIGS. 1-4, 9, and 10.

Figure 9:
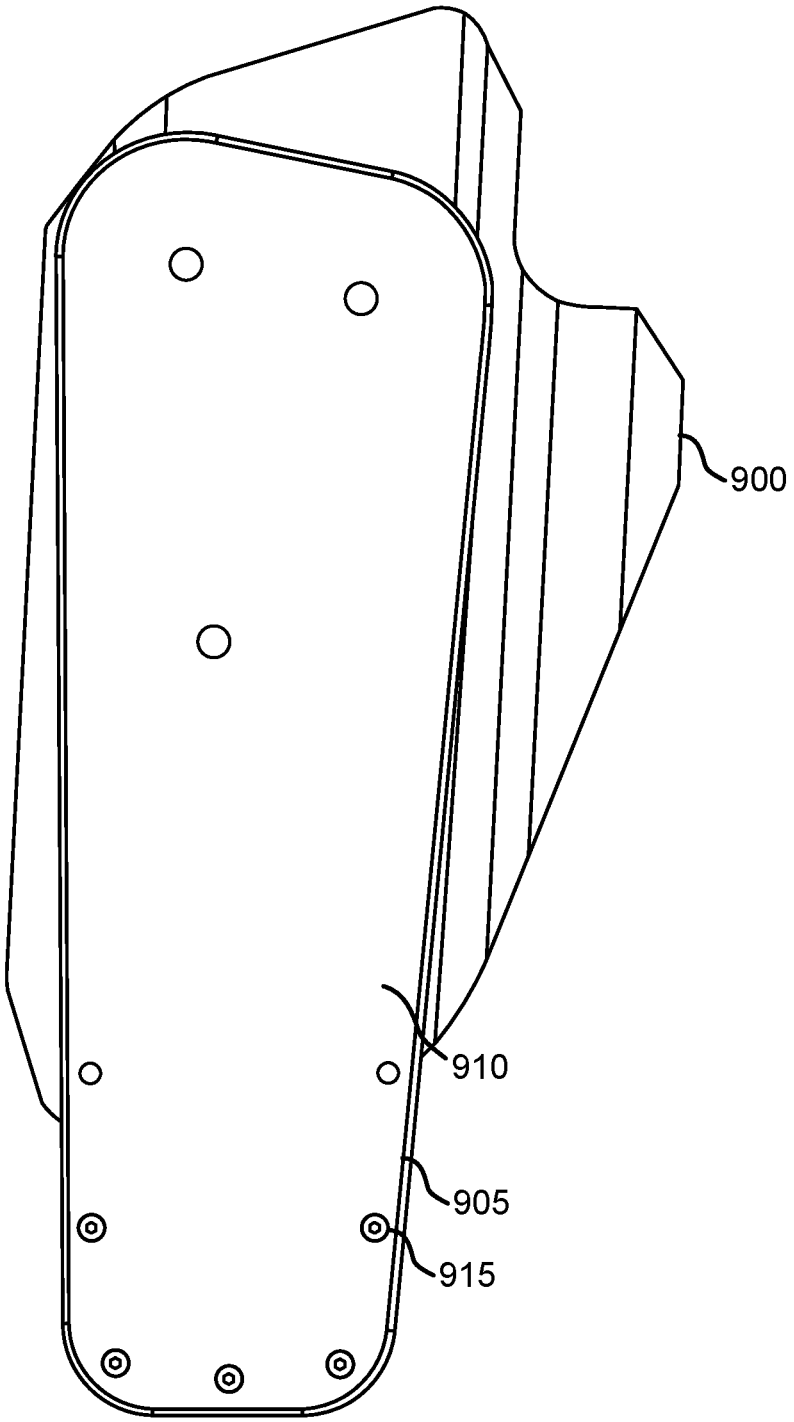
FIG. 9 shows an example of a rear elevation of the holster coupled to the BCD in accordance with aspects of the present disclosure.

FIG. 9 shows an example of a rear elevation of the holster 900 coupled to the BCD 905 in accordance with aspects of the present disclosure. The example shown includes holster 900 and BCD 905.

Holster 900 may be an example of, or include aspects of, the corresponding elements described with reference to FIGS. 7, 8, 10, and 11. BCD 905 may be an example of, or include aspects of, the corresponding elements described with reference to FIGS. 1-4, 7, 8, 10, and 11.

BCD 905 may include backing plate 910 and front screws 915. Backing plate 910 may be an example of, or include aspects of, the corresponding elements described with reference to FIGS. 1-4, 7, and 11. Front screws 915 may be an example of, or include aspects of, the corresponding elements described with reference to FIGS. 1-4, 8, and 10.

Figure 10:
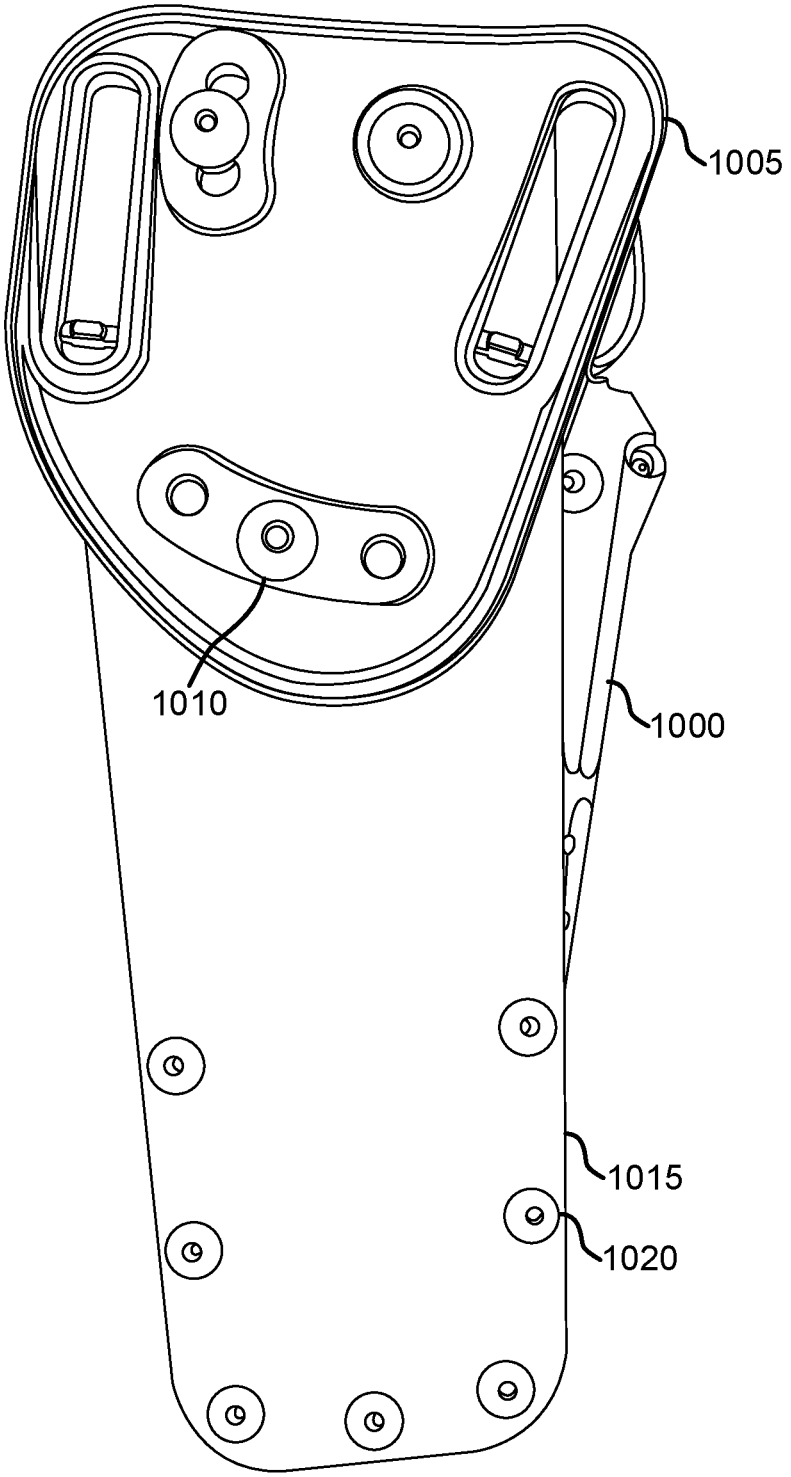
FIG. 10 shows an example of a rear elevation of a holster guard coupled to the holster and BCD in accordance with aspects of the present disclosure.

FIG. 10 shows an example of a rear elevation of a holster guard 1005 coupled to the holster 1000 and BCD 1015 in accordance with aspects of the present disclosure. The example shown includes holster 1000, holster guard 1005, and BCD 1015.

In some embodiments, the holster 1000 is attached to a belt using a separate holster guard 1005 (e.g. a holster guard manufactured by Safariland). In the embodiment shown, the upper holes in the backing plate correspond to holster guard holes. The backing plate is interposed between the holster guard 1005 and the holster 1000, and fasteners in the backing plate holes fasten the holster guard 1005 to the backing plate and holster 1000.

Holster 1000 may be an example of, or include aspects of, the corresponding elements described with reference to FIGS. 7-9, and 11. Holster guard 1005 may include holster guard screws 1010.

BCD 1015 may be an example of, or include aspects of, the corresponding elements described with reference to FIGS. 1-4, 7-9, and 11. BCD 1015 may include front screws 1020. Front screws 1020 may be an example of, or include aspects of, the corresponding elements described with reference to FIGS. 1-4, 8, and 9.

Figure 11:
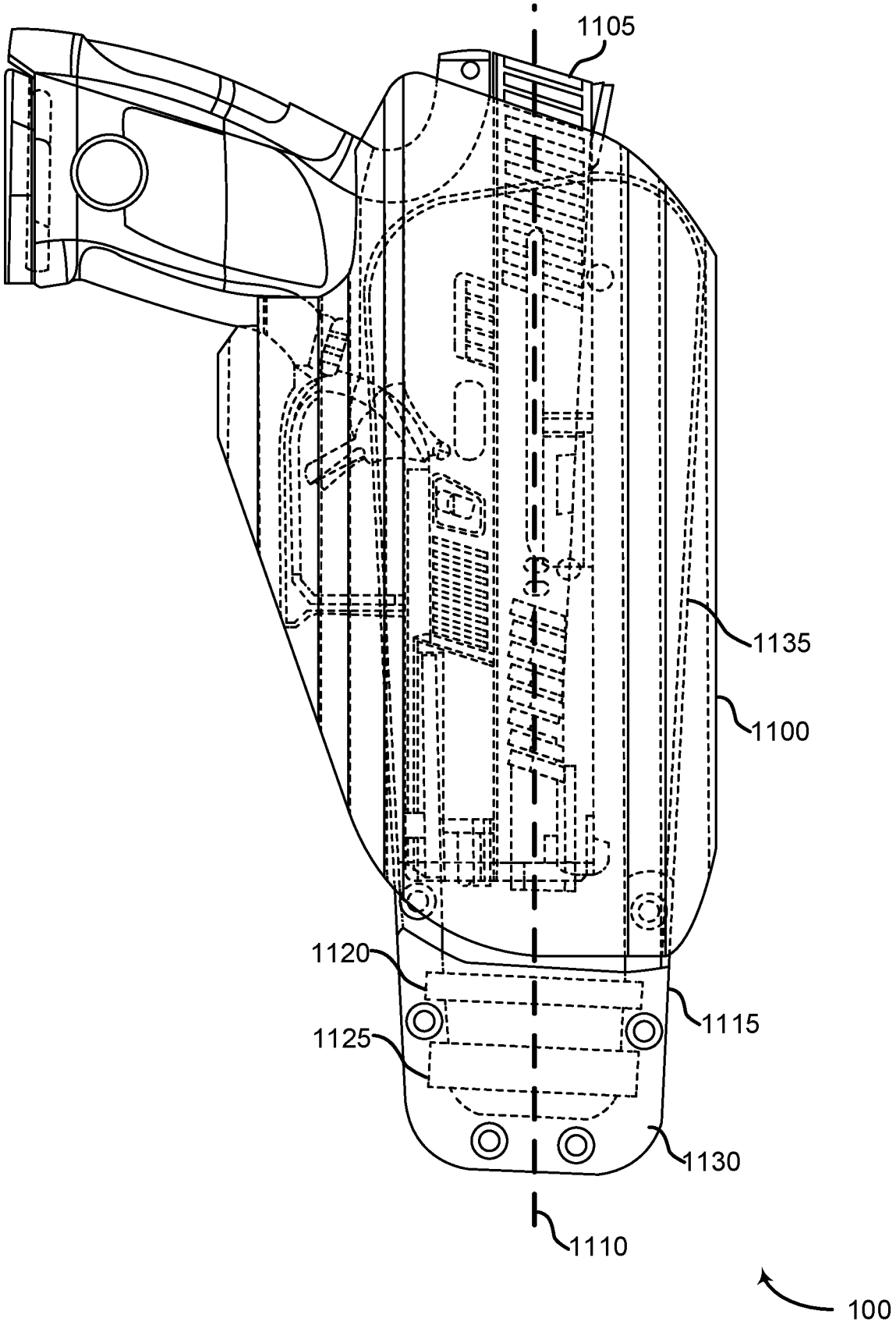
FIG. 11 shows an example of a front elevation showing the holster coupled to the BCD with a firearm seated in the holster in accordance with aspects of the present disclosure.

FIG. 11 shows an example of a front elevation showing the holster 1100 coupled to the BCD 1115 with a firearm 1105 seated in the holster 1100 in accordance with aspects of the present disclosure. The example shown includes holster 1100, firearm 1105, and BCD 1115.

In some embodiments the centerline of the plates 1120, 1125 is generally in line with the axis of the bore of the firearm 1105 when the firearm 1105 is fully seated in the holster 1100. The size of the interior cavity is designed such that if the muzzle is angled slightly forward or slightly rearwards from the fully seated position when discharged, the BCD 1115 will still retain the bullet. In some embodiments slightly is defined as an angle of less than 5 degrees from the fully seated position. In other embodiments slightly is defined as an angle of less than 4 degrees. The BCD 1115 is designed to capture the bullet when the firearm 1105 is 75%-100% of the fully seated position.

Holster 1100 may be an example of, or include aspects of, the corresponding elements described with reference to FIGS. 7-10. Firearm 1105 may discharge a bullet. In some examples, the firearm 1105 is immediately usable by the user while the BCD 1115 is coupled to the holster 1100 (i.e. the BCD does not interfere with normal operation of the holster). Firearm 1105 may include bore axis 1110.

BCD 1115 may be an example of, or include aspects of, the corresponding elements described with reference to FIGS. 1-4, and 7-10. BCD 1115 may include upper plate 1120, lower plate 1125, front cover 1130, and backing plate 1135. Upper plate 1120 may be an example of, or include aspects of, the corresponding elements described with reference to FIGS. 1-3. Lower plate 1125 may be an example of, or include aspects of, the corresponding elements described with reference to FIG. 3. Front cover 1130 may be an example of, or include aspects of, the corresponding elements described with reference to FIGS. 1, 2, and 6-8. Backing plate 1135 may be an example of, or include aspects of, the corresponding elements described with reference to FIGS. 1-4, 7, and 9.

Figure 12:
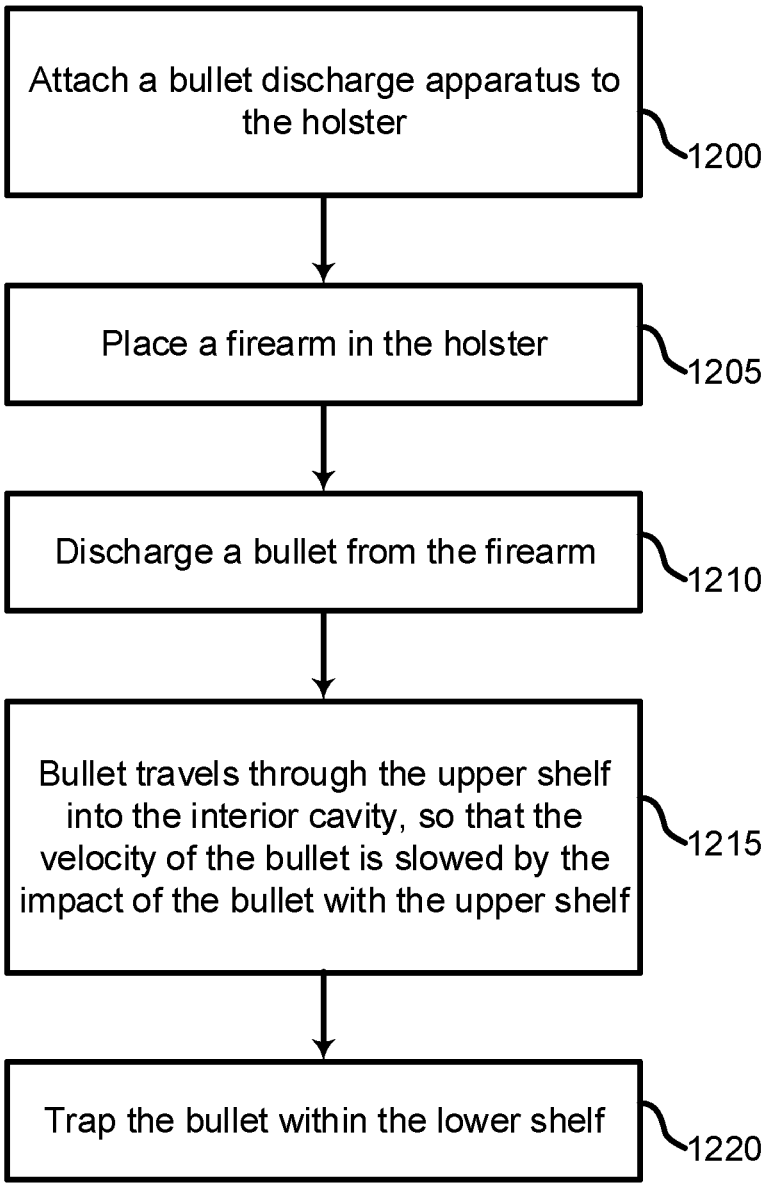
FIG. 12 shows an example of a process for containing discharge from a holstered firearm in accordance with aspects of the present disclosure.

FIG. 12 shows an example of a process for containing discharge from a holstered firearm in accordance with aspects of the present disclosure. In some examples, these operations may be performed using a BCD. Generally, these operations may be performed according to the methods and processes described in accordance with aspects of the present disclosure. For example, the operations may be composed of various substeps, or may be performed in conjunction with other operations described herein.

At step 1200, the user may attach a bullet discharge apparatus to the holster, wherein the bullet discharge apparatus includes a housing, an upper shelf coupled to the housing, an interior cavity bounded in part by the upper shelf and the housing, and a lower shelf parallel to the upper shelf and located in the interior cavity, wherein the interior cavity is generally in line with an axis of a bore of the firearm when the apparatus is coupled to the holster and the firearm is fully seated in the holster. In some cases, the operations of this step may refer to a lower plate as described with reference to FIGS. 3 and 11.

At step 1205, the user may place a firearm in the holster. In some cases, the operations of this step may refer to a holster as described with reference to FIGS. 7-11.

At step 1210, the user may (accidentally or on purpose) discharge a bullet from the firearm. In some cases, the operations of this step may refer to a firearm as described with reference to FIG. 11.

At step 1215, the bullet may travel through the upper shelf into the interior cavity, wherein a velocity of the bullet is slowed by the impact of the bullet with the upper shelf. In some cases, the operations of this step may refer to a upper plate as described with reference to FIGS. 1-3, and 11.

At step 1220, the BCD may trap the bullet within the lower shelf. In some cases, the operations of this step may refer to a lower plate as described with reference to FIGS. 3 and 11.

Figure 13:
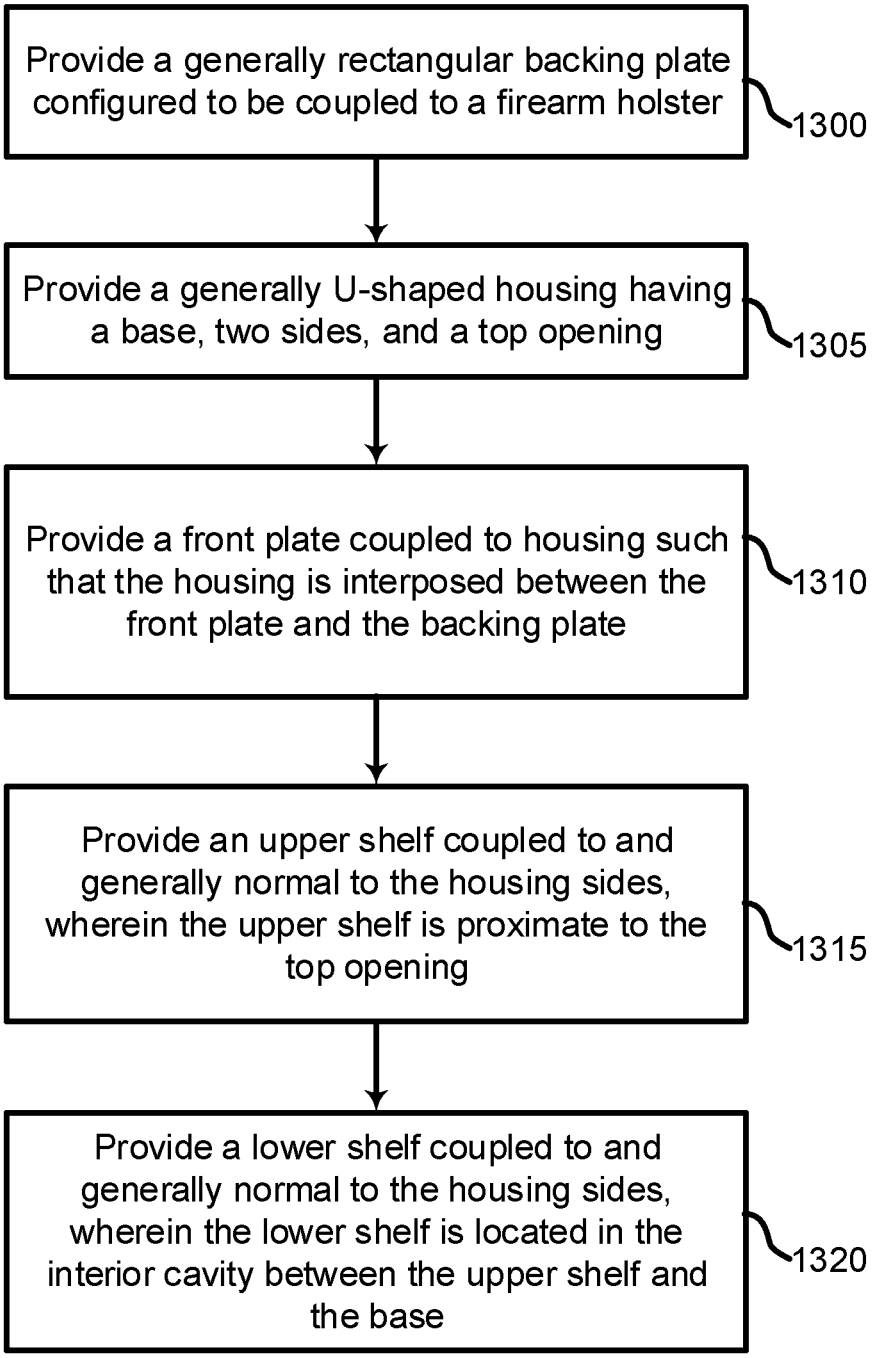
FIG. 13 shows an example of a process for producing a BCD in accordance with aspects of the present disclosure.

FIG. 13 shows an example of a process for producing a BCD in accordance with aspects of the present disclosure. Generally, these operations may be performed according to the methods and processes described in accordance with aspects of the present disclosure. For example, the operations may be composed of various substeps, or may be performed in conjunction with other operations described herein.

At step 1300, the manufacturing system may provide a generally rectangular backing plate configured to be coupled to a firearm holster. In some cases, the operations of this step may refer to a backing plate as described with reference to FIGS. 1-4, 7, 9, and 11.

At step 1305, the manufacturing system may provide a generally U-shaped housing having a base, two sides, and a top opening. In some cases, the operations of this step may refer to a housing as described with reference to FIGS. 3, 5, 7, and 8.

At step 1310, the manufacturing system may provide a front plate coupled to housing such that the housing is interposed between the front plate and the backing plate. In some cases, the operations of this step may refer to a front cover as described with reference to FIGS. 1, 2, 6-8, and 11.

At step 1315, the manufacturing system may provide an upper shelf coupled to and generally normal to the housing sides, wherein the upper shelf is proximate to the top opening, whereby the upper shelf, front plate, housing, and backing plate form an interior cavity generally in line with an axis of a bore of the firearm when the apparatus is coupled to the holster and the firearm is fully seated in the holster, whereby a bullet fired from the firearm while seated in the holster is confined to the interior cavity. In some cases, the operations of this step may refer to a upper plate as described with reference to FIGS. 1-3, and 11.

At step 1320, the manufacturing system may provide a lower shelf coupled to and generally normal to the housing sides, wherein the lower shelf is located in the interior cavity between the upper shelf and the base. In some cases, the operations of this step may refer to a lower plate as described with reference to FIGS. 3 and 11.

The description and drawings described herein represent example configurations and do not represent all the implementations within the scope of the claims. For example, the operations and steps may be rearranged, combined or otherwise modified. Also, structures and devices may be represented in the form of block diagrams to represent the relationship between components and avoid obscuring the described concepts. Similar components or features may have the same name but may have different reference numbers corresponding to different figures.

Some modifications to the disclosure may be readily apparent to those skilled in the art, and the principles defined herein may be applied to other variations without departing from the scope of the disclosure. Thus, the disclosure is not limited to the examples and designs described herein, but is to be accorded the broadest scope consistent with the principles and novel features disclosed herein.

In this disclosure and the following claims, the word "or" indicates an inclusive list such that, for example, the list of X, Y, or Z means X or Y or Z or XY or XZ or YZ or XYZ. Also the phrase "based on" is not used to represent a closed set of conditions. For example, a step that is described as "based on condition A" may be based on both condition A and condition B. In other words, the phrase "based on" shall be construed to mean "based at least in part on."

What is claimed is:

1. An apparatus for containing discharge from a holstered firearm, comprising:

a generally rectangular backing plate configured to be coupled to a firearm holster;

a generally U-shaped housing having a base, two sides, and a top opening;

a front plate coupled to the housing such that the housing is interposed between the front plate and the backing plate;

an upper shelf coupled to and generally normal to the housing sides, wherein the upper shelf is proximate to the top opening, whereby the upper shelf, front plate, housing, and backing plate form an interior cavity generally in line with an axis of a bore of the firearm when the apparatus is coupled to the holster and the firearm is fully seated in the holster, whereby a bullet fired from the firearm while seated in the holster is confined to the interior cavity; and a lower shelf coupled to and generally normal to the housing sides, wherein the lower shelf is located in the interior cavity between the upper shelf and the base.

2. The apparatus of claim 1, wherein:

the upper shelf and lower shelf are comprised of polycarbonate.

3. The apparatus of claim 1, wherein:

the apparatus comprises polycarbonate.

4. The apparatus of claim 1, wherein:

the interior cavity is sealed.

5. The apparatus of claim 4, further comprising:

a visco-elastic polymer contained within a portion of sealed interior cavity between the upper shelf and the lower shelf.

6. The apparatus of claim 1, wherein:

the upper shelf is separated from the lower shelf by a gap of between 8.6 mm (0.34 inches) and 11.2 mm (0.44 inches).

7. The apparatus of claim 1, wherein:

the U-shaped housing comprises a top edge shaped to accommodate the proximate portion of the holster.

8. The apparatus of claim 1, wherein:

the upper shelf has a thickness between 6.35 mm (0.25 inches) and 7 mm (0.275 inches).

9. The apparatus of claim 1, wherein:

the lower shelf has a thickness between 11.4 mm (0.45 inches) and 14 mm (0.55 inches).

10. The apparatus of claim 1, wherein:

the U-shaped housing has a thickness between 11.4 mm (0.45 inches) and 14 mm (0.55 inches).

11. The apparatus of claim 1, wherein:

the upper shelf and lower shelf are comprised of UV-resistant material.

12. The apparatus of claim 1, wherein:

the apparatus consists of UV-resistant material.

13. The apparatus of claim 1, wherein:

the interior cavity is configured to confine the bullet when the firearm is 75-100% of the fully seated position.

14. The apparatus of claim 1, wherein:

the apparatus is configured such that when the apparatus is coupled to the holster the apparatus does not interfere with normal functioning of the holster.

15. A system for containing discharge from a holstered firearm, comprising a firearm, a holster, and a bullet containment device (BCD); the BCD further comprising:

a generally rectangular backing plate configured to be coupled to a firearm holster;

a generally U-shaped housing having a base, two sides, and a top opening;

a front plate coupled to the housing such that the housing is interposed between the front plate and the backing plate;

an upper shelf coupled to and generally normal to the housing sides, wherein the upper shelf is proximate to the top opening, whereby the upper shelf, front plate, housing, and backing plate form an interior cavity generally in line with an axis of a bore of the firearm when the apparatus is coupled to the holster and the firearm is fully seated in the holster, whereby a bullet fired from the firearm while seated in the holster is confined to the interior cavity; and a lower shelf coupled to and generally normal to the housing sides, wherein the lower shelf is located in the interior cavity between the upper shelf and the base.

16. The system of claim 15, wherein:

the upper shelf and lower shelf are comprised of polycarbonate.

17. The system of claim 15, wherein:

the interior cavity is sealed.

18. The system of claim 17, the system further comprising:

a visco-elastic polymer contained within a portion of sealed interior cavity between the upper shelf and the lower shelf.

19. The system of claim 15, wherein:

the upper shelf and lower shelf are comprised of UV-resistant material.

20. The system of claim 15, wherein:

the interior cavity is configured to confine the bullet when the firearm is 75-100% of the fully seated position.

21. The system of claim 15, wherein:

the system is configured such that when the apparatus is coupled to the holster the apparatus does not interfere with normal functioning of the holster.

22. A method for containing discharge from a firearm, comprising:

attaching a bullet discharge apparatus to a holster, wherein the bullet discharge apparatus includes a housing, an upper shelf coupled to the housing, an interior cavity bounded in part by the upper shelf and the housing, and a lower shelf parallel to the upper shelf and located in the interior cavity, wherein the interior cavity is generally in line with an axis of a bore of the firearm when the apparatus is coupled to the holster and the firearm is fully seated in the holster;

placing the firearm in the holster;

discharging a bullet from the firearm;

traveling of the bullet through the upper shelf into the interior cavity, wherein a velocity of the bullet is slowed by the impact of the bullet with the upper shelf; and trapping of the bullet within the lower shelf.

23. The method of claim 22, further comprising:

preventing any bullet fragments from exiting the interior cavity.

24. The method of claim 22, wherein:

the bullet discharge apparatus further comprises a visco-elastic polymer sealed within a portion of interior cavity between the upper shelf and the lower shelf, and the method further comprising traveling of the bullet through the visco-elastic polymer after traveling of the bullet into the interior cavity, whereby the velocity of the bullet is further slowed.

25. The method of claim 22, wherein:

the upper shelf and lower shelf are comprised of UV-resistant material.

26. The method of claim 22, wherein:

The bullet discharge apparatus is configured such that when the bullet discharge apparatus is coupled to the holster the apparatus does not interfere with normal functioning of the holster.

* * * * *